US006086067A

United States Patent [19]

Benoît et al.

[11] Patent Number: 6,086,067

[45] Date of Patent: Jul. 11, 2000

[54] THREE-DIMENSIONAL PUZZLE

[75] Inventors: Pierre Benoît, Mount Royal; David Gareau, Kirkland, both of Canada

[73] Assignee: Distributions Muralex Inc., Quebec, Canada

[21] Appl. No.: 09/089,876

[22] Filed: Jun. 4, 1998

[51] Int. Cl.[7] ..... A63F 9/12

[52] U.S. Cl. ..... 273/157 R; 446/109

[58] Field of Search ..... 273/153 R, 157 R, 273/156; 446/109, 113, 127, 486

[56] References Cited

U.S. PATENT DOCUMENTS

| | | | |
|---|---|---|---|
| 2,104,628 | 1/1938 | Warren | 446/109 |
| 3,368,316 | 2/1968 | Crowder | 446/109 |
| 3,485,496 | 12/1969 | Brunton | 273/157 R |
| 4,824,112 | 4/1989 | Roy | 273/157 R |
| 5,162,010 | 11/1992 | Krebs | 446/113 |
| 5,251,900 | 10/1993 | Gallant | 273/157 R |
| 5,281,185 | 1/1994 | Lee | 446/109 |
| 5,860,650 | 1/1999 | Scobbie et al. | 273/157 R |

*Primary Examiner*—Steven Wong
*Attorney, Agent, or Firm*—Morrison & Foerster LLP

[57] ABSTRACT

A set of interlocking elements capable of being joined together to form a corner piece of a puzzle game that constitutes a three-dimensional pictorial representation of a structure. In one embodiment, the set of interlocking elements comprises a first element that can be folded into a corner configuration. A second generally planar element interlocks through a dovetail-type joint with the first element to maintain the first element in a folded, corner-like configuration. The first and the second elements are provided with image-bearing surfaces that constitute individual pictorial entities contributing to a complete representation of the structure. When the first and the second elements are interlocked, the image-bearing surfaces unite visually to provide image continuity over the exposed surface of the corner piece. In a second embodiment, the set of interlocking element includes three discrete planar elements that unite through male/female joints into a T-shaped configuration.

17 Claims, 5 Drawing Sheets

THREE-DIMENSIONAL PUZZLE

FIELD OF THE INVENTION

The present invention relates to amusement devices, more particularly to a puzzle game consisting of a multitude of irregularly shaped pieces that are fitted together to form a three-dimensional pictorial representation of a building-like structure.

BACKGROUND OF THE INVENTION

A puzzle game is a well-known amusement device that tests the ingenuity and patience of the player. With commonplace puzzle games, the player is required to correctly fit together a collection of small planar pieces. Each piece has an image-bearing surface constituting an individual pictorial entity. When the various pieces of the puzzle are correctly combined, the pictorial entities visually unite to form a large complete image. These types of puzzle games have a bi-dimensional character because all the pieces are interlocked in a co-planar relationship and the resulting assemblage is flat.

To increase the satisfaction and pleasure derived from a puzzle game, toy manufacturers have developed in the past recent years puzzle games providing a three-dimensional pictorial representation of a building-like structure. Such puzzle games include wall pieces that are interlocked in a planar configuration through dovetail joints to form the walls of the building. The walls are joined to one another at the corners of the building by straight tenon and mortise joints that allow the wall pieces on either side of a corner to be united at right angle. The building walls are erected and stand on a /horizontal base that is assembled from a plurality of interlocked base pieces.

The pieces of three-dimensional puzzle games are usually manufactured from polymeric foam backing having the density and thickness dimension required for bearing the weight of the building-like structure. The foam backing is laminated with lithographic film providing each puzzle piece with an image-bearing surface.

A critical element of a three-dimensional puzzle game is the ability of the planar pieces to unite at in a non-planar configuration to form corners. Prior art designs rely on the frictional engagement between a straight tenon and a conforming mortise to interlock the pieces into a corner configuration and prevent unwanted separation that may cause the erected puzzle structure to collapse. When the puzzle pieces are fresh the dimensional tolerances are close to nominal values which makes possible to attain a comparatively tight fit at the corner joints. Accordingly, the level of frictional engagement tenon/mortise is high enough to prevent unintended corner joints separation. However, over time, the fit tenon/mortise may loosen as a result of successive assembly/disassembly of the puzzle parts, or changes in the polymeric foam due to aging. Consequently, the puzzle structure is no longer structurally sound and may partially or totally collapse when subjected a small accidental impact.

OBJECTS AND STATEMENT OF THE INVENTION

An object of the present invention is a set of interlocking elements capable of being joined to form a resistant corner piece for use in a three-dimensional puzzle game.

Another object of the invention is an improved puzzle game utilizing the aforementioned corner piece.

As embodied and broadly described herein, the invention provides a set of interlocking elements capable of being joined together to form a corner (for the purpose of this specification "corner" means the region of the angle formed between two non co-planar surfaces) piece of a puzzle that constitutes a three-dimensional pictorial representation of a building-like (for the purpose of this specification "building" is intended to encompass the constructed edifice as well as the immediate surroundings such as the garden, fences and monuments, among others) structure, said set of interlocking elements comprising:

- a first element including a pair of generally planar segments connected to one another and capable of limited angular movement one relative to the other, at least one of said planar segments including an image-bearing surface that constitutes an individual pictorial entity contributing to a complete representation of the building-like structure; and
- a second generally planar element, said elements being capable of interlocking engagement when said planar segments adopt a non-planar relationship, when said elements are in an interlocked condition said planar locking element precluding said planar segments to acquire a co-planar relationship.

In a most preferred embodiment, the planar segments of the first element are united by a hinge allowing the first element to be folded into a corner configuration. The interlocking engagement with the second planar element is achieved through a dovetail-type joint that includes a flaring tenon projecting from the second element and a conforming mortise on one of the planar segments out near the hinge line. The flaring tenon can be fitted in the mortise only when the first element is folded. When the interlocking engagement is completed, the first element can no longer be folded back and it permanently maintains the corner configuration. Disassembly of the corner piece can only be accomplished by disengaging the dovetail-type joint.

It will be apparent that this corner constructions is significantly more stable and resistant than prior art designs. Even when subjected to repeated assembly and disassembly operations, the corner joint retains its integrity and it is unlikely to suffer from unintended separation in use.

In a highly preferred embodiment, the elements of the corner piece are made from polymeric foam backing that is laminated with lithographic film providing the image-bearing surface. To form the hinge joint in the first element, the foam backing is partially or completely slitted along a parting line. When the foam backing is completely severed the planar segments of the first element are retained to one another by the lithographic film that is sufficiently pliable to allow repeated folding without breaking or cracking.

The above described corner piece is well-suited to effect the union between a wall of the building-like structure and the base of the puzzle. In such embodiment, the second planar element and the planar segment with the tapering mortise are in a co-planar relationship when interlocked and are substantially orthogonal to the other planar segment of the first element. As a result, the corner piece acquires a T-shaped configuration. When the corner piece is positioned upside down (inverted T) the diverging horizontal arms constitute a wide and stable foundation while the upstanding arm provides a primary attachment point to which wall pieces can be connected in order to progressively build-up a puzzle wall. The upstanding element is provided with a male/female peripheral contour to mate with adjoining wall pieces.

Alternatively, the corner piece can be used to effect the union between two vertical walls where one of the walls meets the other one at a location intermediate its longitudinal extremities. For such applications, the corner piece is contoured so that all the arms of the T can interlock with wall pieces.

As embodied and broadly described herein, the invention also provides a set of interlocking elements capable of being joined together to form a corner piece of a puzzle game that constitutes a three-dimensional pictorial representation of a building structure, said set of interlocking elements comprising:

a first element including a pair of generally planar segments connected to one another by a hinge and capable of angular movement one relative to the other, said first element includes an image-bearing surface; and a second generally planar element including an image-bearing surface, said image-bearing surfaces constituting respective pictorial entities contributing to a complete representation of the building structure;

said second planar element and one of said planar segments include complementary male and female joint members capable of interlocking engagement, the joint member on said one planar segment being adjacent to said hinge and accessible to the complementary joint member on said second planar element when said planar segments are in a substantially non-planar relationship, when said joint members acquire said interlocked condition said second planar element is substantially co-planar with said one planar member and said image bearing surfaces unite visually to provide image continuity over said elements.

As embodied and broadly described herein, the invention further provides a three-dimensional puzzle game for assembly into a building-like structure including walls erected from a horizontal base, said three-dimensional puzzle game including:

a plurality of planar wall pieces capable of interlocking in a plane to form a wall of the building structure, each said wall pieces includes an image-bearing outer surface constituting an individual pictorial entity contributing to a complete representation of the building structure;

a foundation corner piece for establishing a union between a wall of said building-structure and said base portion, said foundation corner piece including:

a) a first element including a pair of generally planar segments connected to one another by a hinge and capable of angular movement one relative to the other, said first element includes an image-bearing surface; and b) second generally planar element including an image-bearing surface;

c) said second planar element and one of said planar segments include complementary male and female joint members capable of interlocking engagement, the joint member on said one planar segment being adjacent to said hinge and accessible to the complementary joint member on said second planar element when said planar segments are in a substantially non-planar relationship, when said joint members acquire said interlocked condition said second planar element is substantially co-planar with said one planar segment to form a portion of said base and the other of said planar segment is in an upstanding position, said other planar segment being capable of interlocking engagement in a plane with at least one of said wall pieces in order to build-up the wall of the building-like structure, and the image-bearing surfaces of said first and second elements uniting visually to provide image continuity over said corner piece.

As embodied and broadly described herein, the invention further provides a set of interlocking elements capable of being joined together to form a corner piece of a puzzle that constitutes a three-dimensional pictorial representation of a building structure, said set of interlocking elements comprising:

a first generally planar element;

a second generally planar element including an image-bearing surface, said elements including male and female joint members capable of engagement for interlocking said elements in a corner configuration;

a third generally planar element, said third and first planar elements including a dovetail joint for interlocking said first and third elements in a generally co-planar relationship, said third elements in an interlocked condition with said first element constituting means for precluding separation of said joint members, one of the said first and third elements including an image-bearing surface, when said elements are in the interlocked condition said surfaces unite visually to provide image continuity over said corner piece.

Under a preferred embodiment of this variant of the invention, two or the planar elements trio are united in a co-planar relationship by a dovetail-type joint. The third element is orthogonal to the two others and includes a tongue clamped between the mating members of the dovetail-type joint.

DESCRIPTION OF PREFERRED EMBODIMENTS

Figure 1:
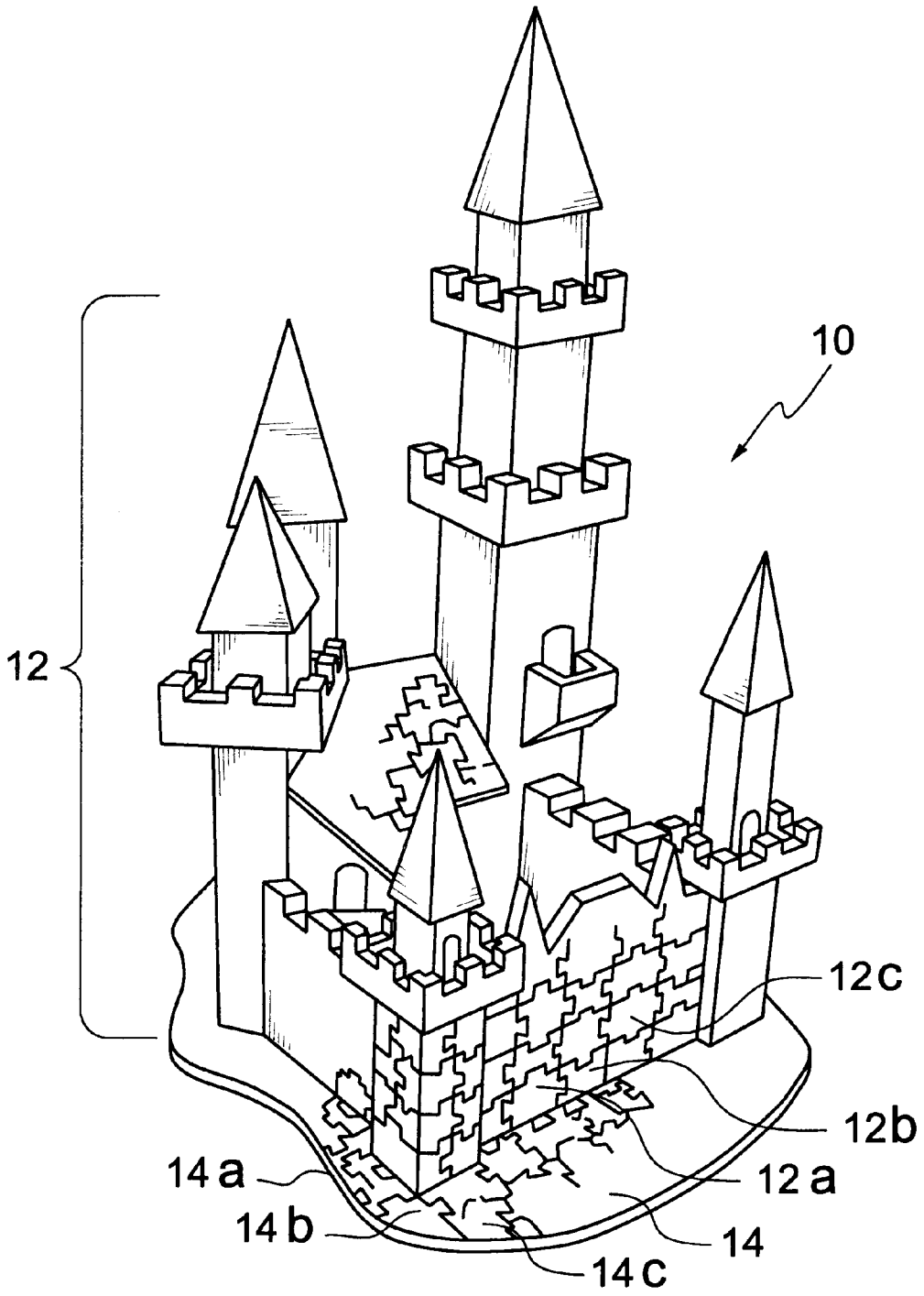
FIG. 1 is a perspective view, partly cut away, of a puzzle game in accordance with the invention shown in the assembled condition.
Figure 2:
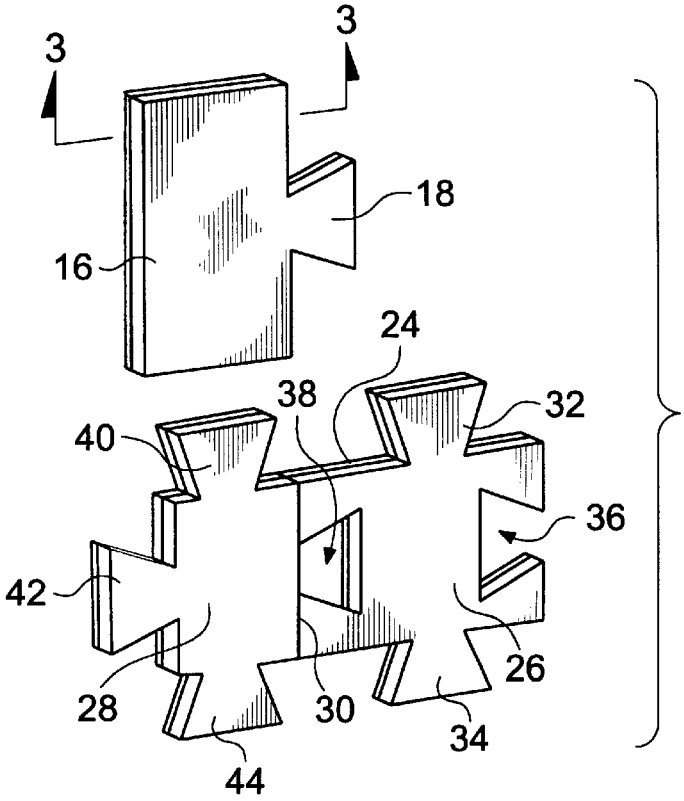
FIG. 2 is an exploded perspective view of a set of interconnecting elements forming a foundation corner piece of the three-dimensional puzzle game shown in FIG. 1.

The present invention provides a set of interlocking elements that can be used to form a corner piece for use in a three-dimensional puzzle game that provides a pictorial representation of a building-like structure. An example of such puzzle game is shown in FIG. 1. When fully assembled the puzzle game presents the three-dimensional image of an ancient castle.

The puzzle game 10 includes two main parts, namely a constructed edifice 12 and a horizontal base 14 supporting the edifice. The base 14 is made up of a plurality of base pieces 14*a,* 14*b,* 14*c,* etc., capable of interlocking in a plane. In a most preferred embodiment, the interlocking engagement is achieved by fitting the base pieces together by dovetail-type joints that feature a flaring tenon fitting into a conforming mortise. Similarly, the edifice construction 12 is made from a plurality of wall pieces 12*a,* 12*b,* 12*c,* etc., fitted together with dovetail-type joints to form walls.

Figure 3:
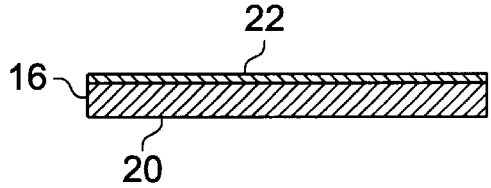
FIG. 3 is cross-sectional view taken along lines 3—3 in FIG. 2.

The present invention provides a foundation corner suitable as a transition element between the base 14 and the construction edifice 12. More particularly, the foundation corner piece provides an upstanding wall piece, solidly anchored to the base 14, to which wall pieces can be fitted to build-up wall. With reference to FIGS. 2 and 4 to 6, the foundation corner piece includes a set of elements that interlock in a corner configuration to form a horizontal base piece that fits with adjacent pieces of the base 14 and a vertically extending wall piece mating with pieces of the puzzle game forming a wall. More particularly, the foundation corner piece comprises a first element 16 in the form of a generally rectangular block from which projects a flaring tenon 18 capable of interlocking engagement with a conforming mortise. FIG. 3 illustrates the element 16 in cross-section. The latter comprises a backing 20 made of polymeric foam-like material that is approximately a quarter of an inch thick. The polymeric foam for manufacturing the backing 20 should possess a sufficient rigidity and density in order to adequately bear the weight of the construction edifice 12. On the top surface of the foam backing 20 is adhered in a face-to-face relationship a lithographic film 22 constituting an image-bearing surface of the first element 16. The image bearing surface is a pictorial entity that cooperates visually with the image bearing surfaces of adjoining puzzle pieces to construct the image of the external surface of the ancient castle or any other building-like structure represented by the puzzle game.

Referring back to FIG. 2, the foundation corner piece also includes a second element 24 constituted by a pair of segments 26 and 28 interconnected by a linear hinge joint 30. The segment 26 constitutes a base piece of the corner and it is designed to interlock in a plane with the other pieces of the base 14. At this end, the segment 26 comprises a plurality of dovetail-type joint members namely a pair of flaring tenons 32 and 34 and a tapering mortise 36. In addition, the segment 26 comprises a special purpose tapering mortise 38 having a mouth opening at the hinge line 30.

The second segment 28 is similar in construction to the first segment in that it comprises a plurality of dovetail-type joint members such as the flaring tenons 40, 42 and 44 for interlocking in a plane with wall pieces of the puzzle game.

Figure 4:
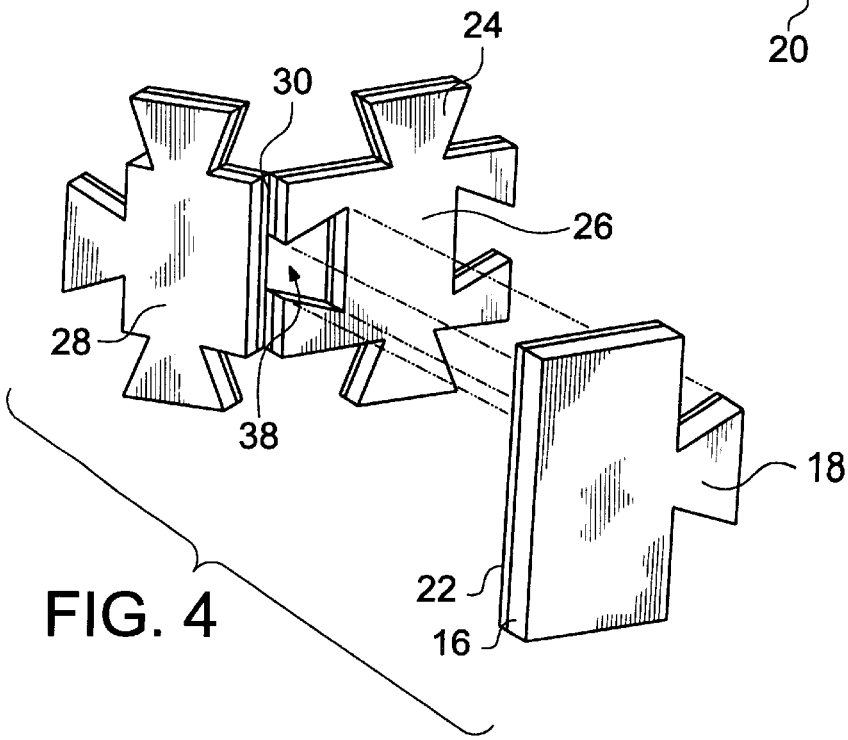
FIG. 4 is similar to FIG. 2 except that one of the elements of the set is shown in a partially folded condition.
Figure 5:
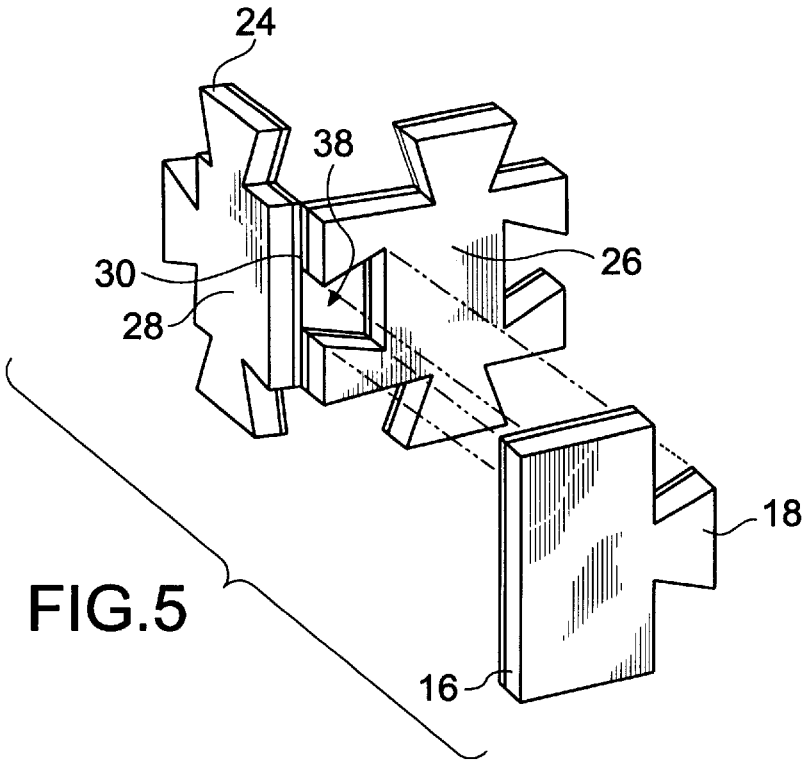
FIG. 5 is a perspective view of the set of interlocking elements located in a proper relationship to allow the interlocking engagement to be effected.

The process for assembling the first element 16 and the second element 24 of the corner piece is illustrated in FIGS. 4 and 5. By virtue of the hinge joint 30, the segments 26 and 28 are pivoted one relative to the other to bring the second element 24 to a corner configuration in which the segments 26 and 28 are substantially orthogonal. In this position, the mortise 38 is exposed and the flaring tenon 18 of first element 16 can be fitted therein. When the interlocking engagement is completed, the first element 16 is in a co-planar relationship with the segment 26 and it is orthogonal to the segment 28.

The second element 24 is constructed in a similar fashion as the first element 16. More particularly, the second element 24 includes a backing 20 of polymeric foam material overlaid by a lithographic film layer 22. To form the hinge joint 30, the foam backing 20 is slit along the hinge line so that the lithographic layer 22 constitutes the agency for holding the segments 26 and 28 together. The lithographic layer also provides the hinge function by locally bending when the segments 26 and 28 move angularly one relative to the other.

In selecting the material for use as the lithographic film 22, the flexibility characteristics of such material become an important factor so that the lithographic film can adequately perform the function of a hinge without prematurely cracking or tearing.

The image printed or otherwise impressed on the lithographic film 22 or the elements 16 and 24 is related in such a way as to provide image continuity over the corner piece when its elements are interlocked. More particularly, the image on the segment 26 visually unites with the small image on the flaring tongue 18 so that an observer will perceive a continuous image by looking at the exposed surface of the corner piece.

It will be apparent to those skilled in the art that the number of joint members for fitting base or wall puzzle pieces to the corner piece, their precise location as well as their gender (tenon or mortise) is dictated by the specific application. In the example described above, only the second element 24 is configured to interlock with puzzle pieces. The first element 16 is not required to connect with any other puzzle piece (except with element 24) because it is behind the plane of the wall (materialized by the segment 28) of the edifice construction 12 and forms the inner boundary of the base 14.

The sides of the elements 16 and 24 that receive the lithographic film 22 are determined in accordance with how the corner piece interrelates with the other puzzle pieces. The orientation of the corner piece in the environment of the specific building-like structure represented by the puzzle game dictates what areas of the corner piece constitute its visible exposed surface. In turn, those areas need to be furnished with image-bearing surfaces that visually unite among themselves and also unite with the adjoining puzzle pieces to provide image continuity.

A variant of the corner piece in accordance with the invention is shown in FIGS. 7 to 11. This corner piece comprises three discrete planar elements 46, 48 and 50 that are releasably interlocked in a T-shaped configuration. The element 46 has a peripheral contour shaped to form a plurality of tapered mortises 52, 54 and 56 that interlock with adjoining wall pieces of the edifice construction 12. The element 46 also includes a flaring tenon 58 provided for interlocking engagement with the elements 48 and 50.

The element 48 is provided with a deep recess 60 in which the tenon 58 is clamped as it will be described later. The element 48 also comprises a peripheral contour including a pair of tapering mortises 62 and 64 intended to interlock in a plane with the adjacent pieces of the base 14. On either side of the recess 60 are provided a pair of flaring tenons 66 and 70 that can be fitted in complementary mortises 72 and 74 of the third planar member 50. The latter also comprises a projection 76 that penetrates partially within the recess 60 and several dovetail-type joint members 78, 80 and 82 to interlock with adjacent pieces of the base 14.

Figure 8:
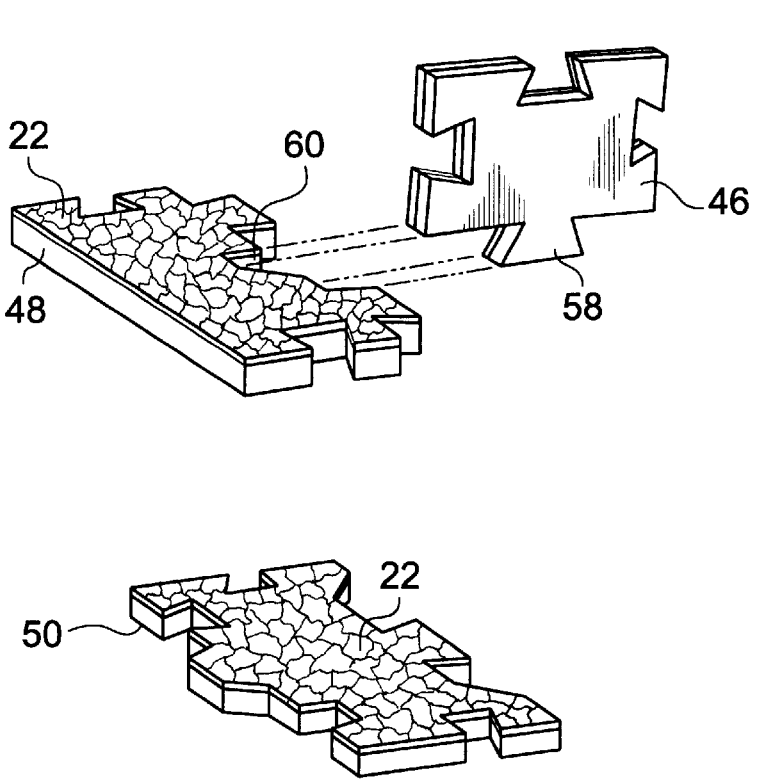
FIG. 8 is a perspective view of the set shown in FIG. 7, depicting two of the elements aligned one relative to the other immediately prior being fitted together.
Figure 9:
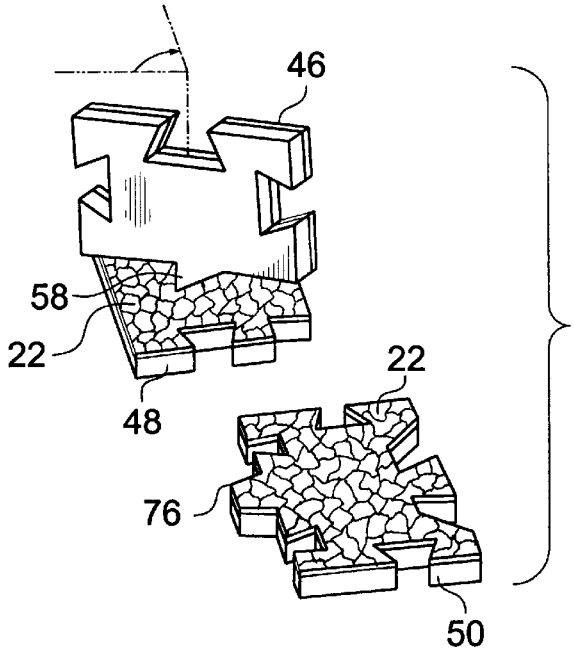
FIG. 9 is a perspective view of the set of interlocking elements shown in FIGS. 7 and 8, illustrating the rotational movement of a first element required to complete the interlocking engagement with a second element of the trio.
Figure 10:
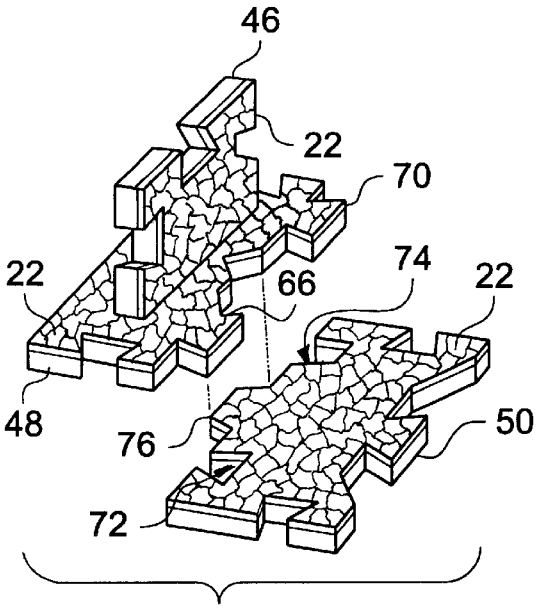
FIG. 10 is a perspective view of the set of interlocking elements shown in FIGS. 7, 8 and 9 illustrating a third element of the set aligned with the first and the second elements in order to complete the assembly of the corner piece.

In order to assemble the foundation corner piece, the flaring tongue of the first element 46 is inserted in the recess 60 as shown in FIG. 8. The first element 46 is rotated by a quarter of a circle about a vertical axis to bring the elements 46 and 48 in a position where their longitudinal axis are parallel. The transverse dimension of the flaring tongue 58 slightly exceeds the width of the recess 60 to create an interference fit. Finally, the third element 50 is interlocked in a co-planar relationship with the first element 46. The interlocking engagement is achieved by sliding the flaring tenons 66 and 70 in the conforming mortises 72 and 74. By virtue of this engagement, the projection 76 penetrates the recess 60 and abuts against the tenon 58 to lock the assembly.

Figure 11:
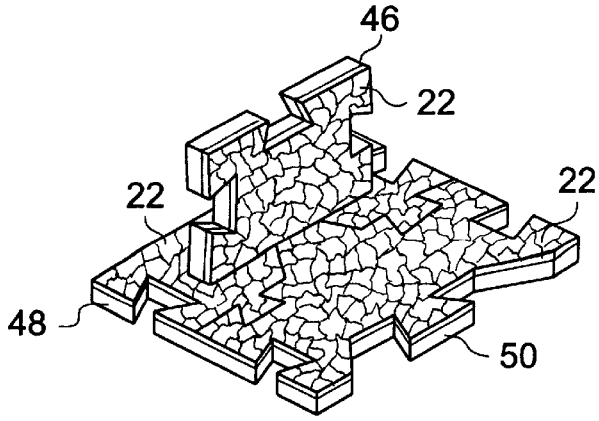
FIG. 11 is a perspective view of the set of interlocking elements in accordance with the variant shown in the fully interlocked condition.

As in the case of the previous embodiment, the elements 46, 48 and 50 are made of polymeric foam laminated with a lithographic film to provide an image-bearing surface. The images on the various elements are coordinated to visually unite when the corner piece is assembled. This feature is best shown in FIG. 11. In this example, the elements 46, 48 and 50 are used as a foundation corner piece. The vertical element 46 bears the image of a brick wall that is found at the base of a building. The horizontal elements 48 and 50 depict a portion of the garden surrounding the building. For instance, two circular stones 51 and 53 are visible forming a portion of a walkway. The stones 51 and 53 are surrounded with what appears to be grass.

Figure 6:
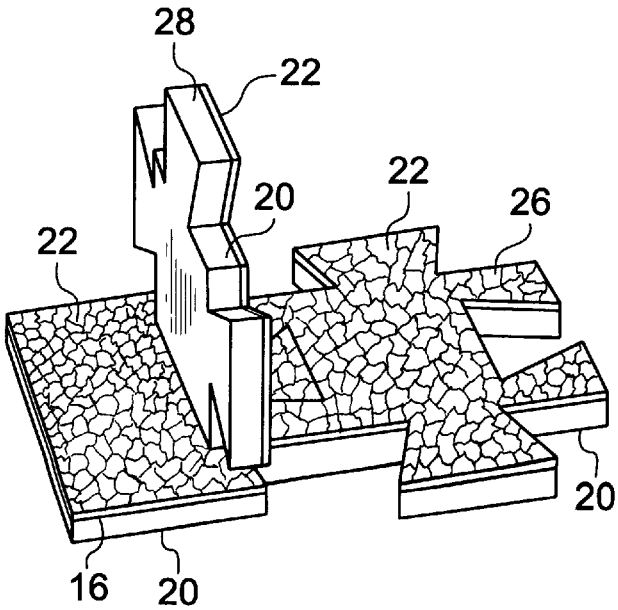
FIG. 6 is a perspective view of the set of interlocking elements in the interlocked condition.
Figure 7:
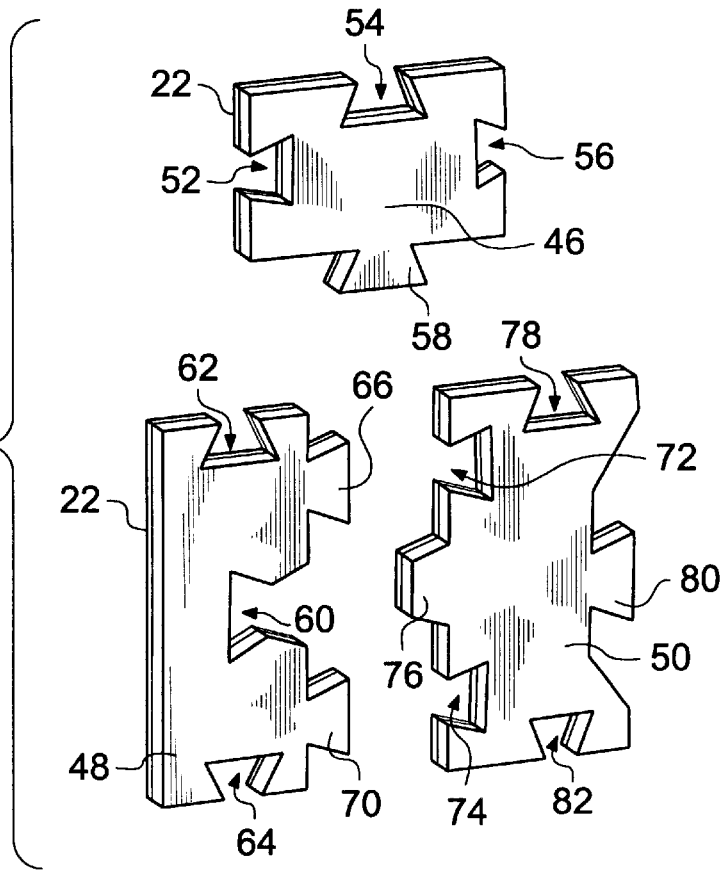
FIG. 7 is an exploded perspective view of the set of interlocking elements in accordance with a variant.

The corner pieces under the embodiments described above have inverted-T shaped configurations and can be used in a variety of corner arrangements. In an embodiment that was discussed earlier, the T-shaped corner piece is used as a transition unit joining the base of the puzzle game to a wall of the edifice construction, as best shown in FIG. 6. Here, the segment 26 and the first element 16 form part of the base while the segment 28 joins the wall.

The T-shaped corner piece can also be used to join vertical walls. For instance, the corner piece can serve as a transition unit between a first vertical wall meeting a second vertical wall at a location intermediate its longitudinal extremities. In this embodiment all the wings of the T may need to be configured so as to interlock with adjoining wall pieces. In addition, image-bearing surfaces may be required on all the surfaces of the corner piece if those surfaces are exposed. In such case, the elements of the corner piece necessitate a second lithographic film disposed on the main surface of the foam backing opposite the first lithographic film.

The method for manufacturing the puzzle game in accordance with the invention consists of designing the laminated film 22 to provide a bi-dimensional image of the outer surface of the building-like structure. The lithographic film is then adhesively mounted on a large sheet of foam backing 20. The lamination is then die-cut to form in a single operation the various pieces of the puzzle game, including the elements of the foundation corner piece. When the embodiment of FIGS. 2 to 6 is being produced, the hinge line 30 is created by slitting the foam backing 20 at the area where the hinge line 30 is desired.

The corner piece in accordance with the invention can be modified and refined to suit specific applications, without departing from the spirit of the invention. Therefore, the above description of invention should not be interpreted in any limiting matter. The scope of the invention is defined in the appended claims and their equivalents.

We claim:

1. A set of interlocking elements capable of being joined together to form a corner piece of a puzzle that constitutes a three-dimensional pictorial representation of a structure, said set of interlocking elements comprising:

a) a first element including a pair of generally planar segments connected to one another and capable of limited angular movement one relative to the other, at least one of said planar segments including an image-bearing surface that constitutes an individual pictorial entity contributing to a complete representation of the building structure; and b) a second generally planar element, said elements being capable of interlocking engagement when said planar segments adopt a non-planar relationship, when said elements are in an interlocked condition said second planar element precluding said planar segments to acquire a co-planar relationship, and one of said elements includes a joint member capable of interlocking engagement in a plane with a complementary joint member of another element of the puzzle, whereby allowing to build-up a section of the structure.

2. A set of interlocking elements as defined in claim 1, wherein the joint member on said one element is selected in the group consisting of female joint member and male joint member.

3. A set of interlocking elements as defined in claim 1, wherein the joint member on said one element includes either one of a flaring tenon and tapered mortise.

4. A set of interlocking elements as defined in claim 1, wherein the joint member on said one element is formed on one of said planar segments.

5. A set of interlocking elements as defined in claim 1, wherein said second element includes an image-bearing surface constituting an individual pictorial entity contributing to a complete representation of the structure, said image bearing surfaces being in a generally co-planar relationship when said elements are in said interlocked condition and the respective pictorial entities uniting visually to provide image continuity over said elements.

6. A set of interlocking elements as defined in claim 1, wherein said planar segments are interconnected by a hinge joint.

7. A set of interlocking elements as defined in claim 1, wherein said planar segments are connected to one another by a hinge and said second planar element and one of said planar segments include complementary male and female joint members capable of interlocking engagement, the joint member on said one planar segment being adjacent to said hinge and accessible to the complementary joint member on said second planar element when said planar segments are in a substantially non-planar relationship.

8. A set of interlocking elements as defined in claim 7, wherein said joint members form a dovetail-type joint that includes a flaring tenon and tapered mortise.

9. A set of interlocking elements as defined in claim 1, wherein each said first and second elements include a body of backing material that is laminated with a film constituting the image-bearing surface.

10. A set of interlocking elements as defined in claim 9, wherein said backing material is polymeric foam.

11. A set of interlocking elements as defined in claim 9, wherein the body of backing material of said first element is split along a juncture between said planar segments to form said hinge.

12. A set of interlocking elements as defined in claim 1, wherein when said joint members acquire said interlocked condition said second planar element is substantially co-planar with said one planar segment to form a portion of a horizontal base of the structure and the other of said planar segment is in an upstanding position, said other planar segment being capable of interlocking engagement in a plane with at least one wall piece in order to build-up a section of the structure, said second planar element including an image-bearing surface whereby the image-bearing surfaces of said at least one of said planar segments and said second planar element uniting visually to provide continuity over said corner piece.

13. A set of interlocking elements capable of being joined together to form a corner piece of a puzzle that constitutes a three-dimensional pictorial representation of a structure, said set of interlocking elements comprising;

a) a first generally planar element;

b) a second generally planar element including an image-bearing surface, said elements including male and female joint members capable of engagement for interlocking said elements in a corner configuration;

c) a third generally planar element, said third and first planar elements including a dovetail joint for interlocking said first and third elements in a generally co-planar relationship, said third element in an interlocked condition with said first element constituting means for precluding separation of said joint members, one of said first and third elements including an image-bearing surface, when said elements are in the interlocked condition said surfaces unite visually to provide image continuity over said corner piece; and d) one of said planar elements includes a joint member capable of interlocking engagement in a plane with a complementary joint member of another element of the puzzle, whereby allowing to build-up a section of the structure.

14. A set of interlocking elements as defined in claim 13, wherein said elements provide a foundation corner piece for erecting an upstanding section of said structure.

15. A three-dimensional puzzle game for assembly into a building-like structure including walls erected from a horizontal base, said three-dimensional puzzle game including:

a plurality of planar wall pieces capable of interlocking in a plane to form a wall of the building structure, each said wall pieces includes an image-bearing outer surface constituting an individual pictorial entity contributing to a complete representation of the building structure;

a foundation corner piece for establishing a union between a wall of said building-structure and said base portion, said foundation corner piece including:

a) a first element including a pair of generally planar segments connected to one another by a hinge and capable of angular movement one relative to the other, said first element includes an image-bearing surface; and b) second generally planar element including an image-bearing surface;

c) said second planar element and one of said planar segments include complementary male and female joint members capable of interlocking engagement, the joint member on said one planar segment being adjacent to said hinge and accessible to the complementary joint member on said second planar element when said planar segments are in a substantially non-planar relationship, when said joint members acquire said interlocked condition said second planar element is substantially co-planar with said one planar segment to form a portion of said base and the other of said planar segment is in an upstanding position, said other planar segment being capable of interlocking engagement in a plane with at least one of said wall pieces in order to build-up the wall of the building-like structure, and the image-bearing surfaces of said first and second elements uniting visually to provide image continuity over said corner piece.

16. A set of interlocking elements capable of being joined together to form a corner piece of a puzzle that constitutes a three-dimensional pictorial representation of a building structure, said set of interlocking elements comprising:

a first generally planar element;

a second generally planar element including an image-bearing surface, said elements including male and female joint members capable of engagement for interlocking said elements in a corner configuration;

a third generally planar element, said third and first planar elements including a dovetail joint for interlocking said first and third elements in a generally co-planar relationship, said third elements in an interlocked condition with said first element constituting means for precluding separation of said joint members, one of said first and third elements including an image-bearing surface when said elements are in the interlocked condition said sufaces unite visually to provide image continuity over said corner piece.

17. A set of interlocking elements as defined in claim 16, wherein said elements provide a foundation corner piece for erecting a wall of said building-like structure.

* * * * *